US006098595A

United States Patent [19]

Peters et al.

[11] Patent Number: 6,098,595

[45] Date of Patent: Aug. 8, 2000

[54] INTAKE PORT INJECTION SYSTEM WITH SHARED INJECTORS

[75] Inventors: Lester L. Peters; A. S. Ghuman; Philip M. Dimpelfeld, all of Columbus; Randy P. Hessel, Bloomington, all of Ind.

[73] Assignee: Cummins Engine Company, Inc., Columbus, Ind.

[21] Appl. No.: 09/134,915

[22] Filed: Aug. 17, 1998

[51] Int. Cl.[7] ..... F02B 15/00

[52] U.S. Cl. ..... 123/432; 123/308

[58] Field of Search ..... 123/308, 432

[56] References Cited

U.S. PATENT DOCUMENTS

| | | | |
|---|---|---|---|
| Re. 27,909 | 2/1974 | Huber . | |
| 2,757,968 | 8/1956 | Campbell . | |
| 2,995,123 | 8/1961 | Göschel . | |
| 3,782,639 | 1/1974 | Boltz et al. . | |
| 4,538,574 | 9/1985 | Lombardi . | |
| 4,627,400 | 12/1986 | Takata et al. | 123/432 |
| 4,726,343 | 2/1988 | Kruger . | |
| 4,982,716 | 1/1991 | Takeda et al. . | |
| 5,094,210 | 3/1992 | Endres et al. . | |
| 5,294,056 | 3/1994 | Buchholz et al. . | |
| 5,429,086 | 7/1995 | Glackin | 123/188.14 |
| 5,477,830 | 12/1995 | Beck et al. . | |
| 5,515,822 | 5/1996 | Kobayashi et al. | 123/432 |
| 5,515,827 | 5/1996 | Rutschmann et al. | 123/432 |
| 5,520,157 | 5/1996 | Pontoppidan . | |

*Primary Examiner*—John Kwon

*Attorney, Agent, or Firm*—Nixon Peabody LLP; Charles M Leedom, Jr.; Tim L. Brackett, Jr.

[57] ABSTRACT

A multi-cylinder internal combustion engine is provided with an intake port injection system capable of effectively delivering port injected quantities of fuel to each cylinder while minimizing the number and size of the fuel injectors. The intake port injection system of the present invention includes a siamese or shared port arrangement having a plurality of common intake inlets, each delivering air from an intake manifold to one intake port of one cylinder and an intake port of a different cylinder. Two single intake inlets are also provided for delivering intake air solely to a single respective cylinder. Importantly, in a multi-cylinder engine having a total number of cylinders equal to N, the number of intake inlets, both common and single, equals N+1. Importantly, the total number of injectors also equals N+1. Although each intake inlet is served by only one injector, two injectors operate simultaneously to deliver fuel to a single cylinder via respective intake inlets. As a result, each injector only delivers half the total fuel quantity for a given injection and intake event resulting in smaller sized injectors and ultimately a reduction in packaging concerns and costs.

17 Claims, 3 Drawing Sheets

INTAKE EVENTS: OPENS 15 - 30° BTDC
CLOSES 20 - 60° ABDC
MAX DURATION = 30° BTDC AND 60° ABDC

INTAKE PORT INJECTION SYSTEM WITH SHARED INJECTORS

TECHNICAL FIELD

The present invention relates to a port fuel injection system for an internal combustion engine which effectively delivers the desired quantity of fuel to the designated cylinder while minimizing the number and size of fuel injectors.

BACKGROUND OF THE INVENTION

Many existing engines include an intake port injection system for injecting fuel, e.g. liquid or gaseous, into the intake port for delivery to one or more engine cylinders. These engines may also include two intake valve ports and two exhaust valve ports for each cylinder. Consequently, each set of two intake ports are served by an intake inlet dedicated to the respective cylinder. In the dedicated intake inlet arrangement, the fuel is injected into the ports using one of three arrangements. First, a single dual stream injector may be used for each cylinder to direct a fuel spray at each port, such as disclosed in U.S. Pat. No. 4,982,716. The dual injector injects the fuel when the intake valve is closed. Second, a single injector without dual streams may be used but results in poor distribution. Third, one injector may be used for each port. Although achieving effective distribution of fuel, two injectors per cylinder is unnecessarily expensive and often difficult to position within the packaging constraints of the engine.

A shared or siamese port arrangement in combination with a single intake port design may also be used to limit the number of injectors by mounting one injector in the common intake inlet to the ports as disclosed in U.S. Pat. No. 5,477,830 issued to Beck et al. In this shared port arrangement, the intake port from adjacent cylinders share a common intake inlet. The fuel stream is injected into the intake air while the intake valve associated with only one of the cylinders is open and the other intake valve closed. As a result, the fuel charge is entrained by the high velocity air charge flowing into the cylinder associated with the open intake valve. However, Beck et al. only suggests an intake port injection system for an engine having only one intake port per cylinder.

Consequently, there is a need for an intake port injection system for a multi-cylinder engine having dual intake ports which minimizes the number of injectors while ensuring accurate and reliable fuel delivery to the cylinders.

SUMMARY OF THE INVENTION

It is an object of the present invention, therefore, to overcome the disadvantages of the prior art and to provide an inexpensive intake port injection system for an engine which is capable of effectively distributing fuel to the engine cylinders.

Another object of the present invention is to provide an engine, having dual intake valves per cylinder, with an intake port injection system having a minimum number of injectors.

Yet another object of the present invention is to provide an engine, having dual intake valves per cylinder, with an intake port injection system including injectors of minimal size yet appropriate capacity.

Still another object of the present invention is to provide an intake port injection system for a shared or Siamese intake port arrangement including half capacity injectors capable of mounting within the packaging constraints of existing engines.

A further object of the present invention is to provide an intake port injection system for a shared or siamese intake port arrangement including half capacity injectors capable of achieving optimum delivery and distribution of fuel.

These and other objects of the present invention are achieved by providing a multi-cylinder internal combustion engine comprising a plurality of cylinders for receiving intake air and fuel wherein the total number of cylinders equals N, and a respective pair of intake ports associated with each of the cylinders for directing intake air into the respective cylinder. The engine also includes an intake manifold and a plurality of intake inlets for delivering intake air from the manifold to the intake ports. The plurality of intake inlets include one or more common intake inlets equal in number to N−1. Each of the one or more common intake inlets is connected to both a first intake port associated with one of the plurality of cylinders and a second intake port associated with a different one of the plurality of cylinders. The plurality of intake inlets also includes a plurality of single intake inlets. The engine further includes a plurality of injectors for injecting fuel into the intake inlets wherein the total number of injectors equals N+1. Each of the plurality of injectors is associated with only one of the plurality of intake inlets. Preferably, the total number of intake inlets equals N+1. Also, two of the injectors preferably operate simultaneously to deliver fuel through respective intake inlets for delivery to one of the pair of intake ports of one cylinder. The injectors are preferably mounted on the intake manifold and the intake manifold is preferably formed integrally in the cylinder head. A pair of intake valves is provided in association with each pair of intake ports and the injectors operate during the opening of the respective pair of intake valves.

The plurality of cylinders may be positioned along a common longitudinal axis to form a bank of cylinders including a first end cylinder positioned at a first end of the bank of cylinders and a second end cylinder positioned at a second opposite end of said bank of cylinders. The total number of single intake inlets equals two so that a first single intake inlet is positioned at the first end of the bank of cylinders and a second single intake inlet is positioned at the second opposite end of the bank of cylinders.

DETAILED DESCRIPTION OF THE PREFERRED EMBODIMENT

Figure 1:
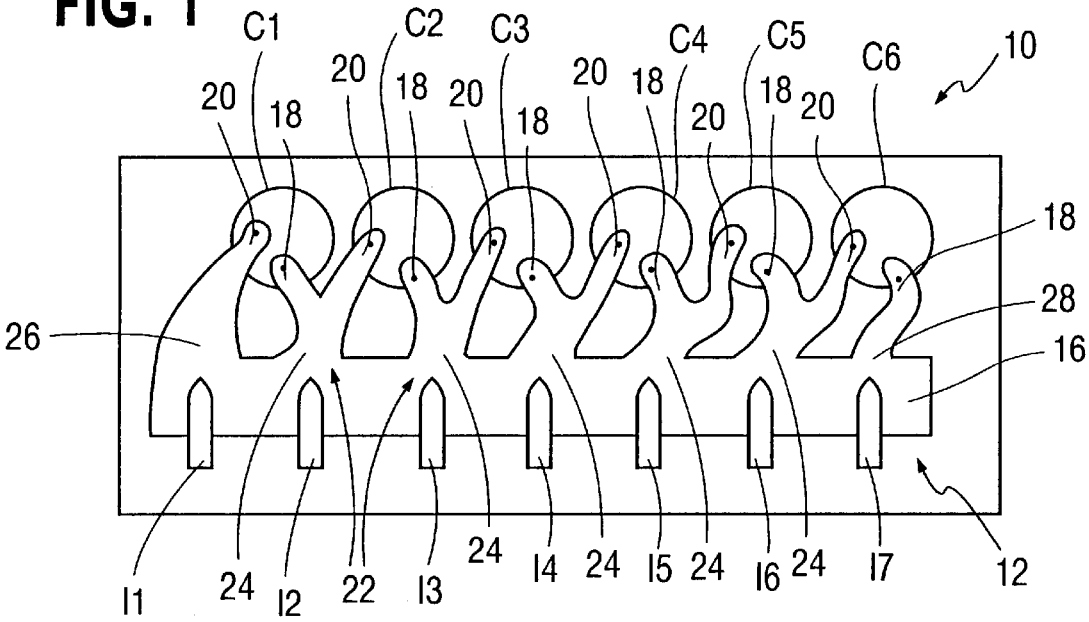
FIG. 1 is a schematic view of an engine having the intake port injection system of the present invention.
Figure 2:
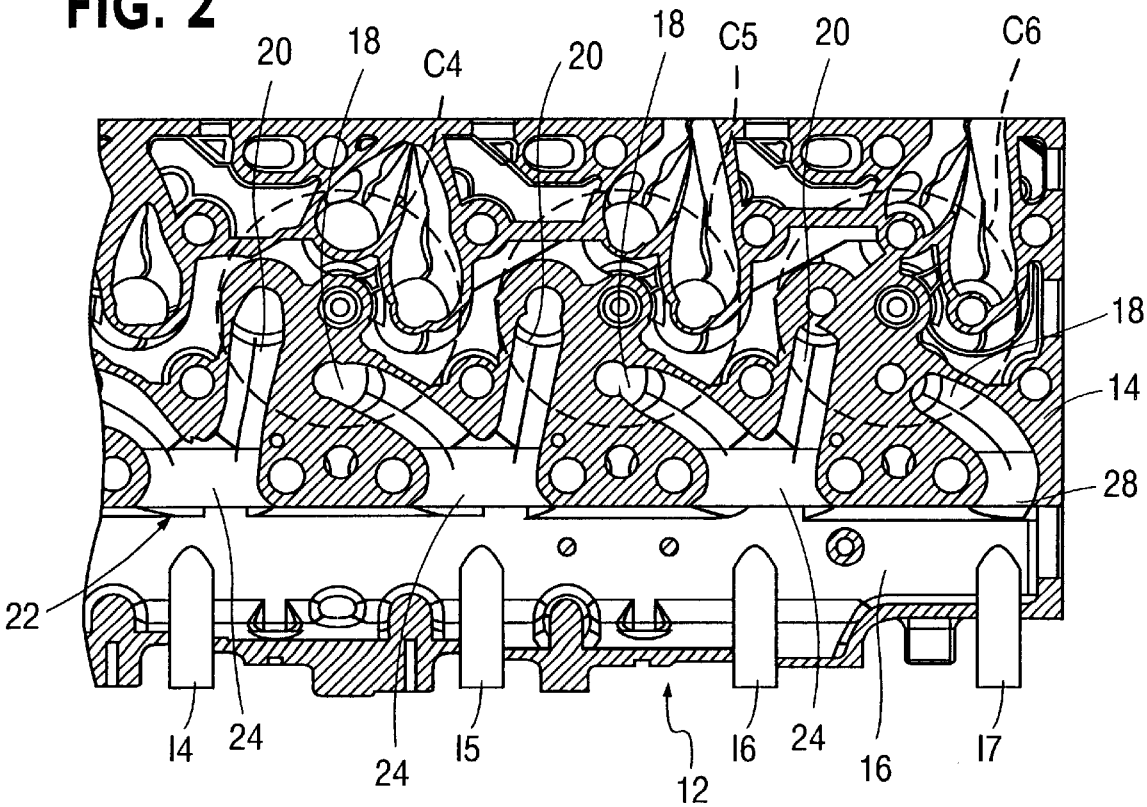
FIG. 2 is a cross sectional view of a portion of the cylinder head of the engine of FIG. 1 showing the intake port injection system of the present invention as applied to three cylinders of a six cylinder engine.

Referring to FIGS. 1 and 2, there is shown a multi-cylinder internal combustion engine, indicated generally at 10, including the intake port injection system of the present invention indicated generally at 12. Intake port injection system 12 generally includes a Siamese or shared port arrangement as shown in FIG. 1 in combination with a plurality of injectors of a specific number and capacity arranged to minimize the size of the injectors, permit easier packaging and minimize the number of injectors and thus the cost of the overall system. Multi-cylinder internal combustion engine 10, in the preferred embodiment, includes a plurality of cylinders C1, C2, C3, C4, C5 and C6 for receiving respective reciprocally mounted pistons (not shown) in a conventional manner to form a six-cylinder engine. However, the intake port injection system 12 of the present invention may be used with any multi-cylinder internal combustion engine having a siamese or shared intake port arrangement and any number N of cylinders, for example, 2, 4, 8, 12 arranged in-line or in a V-type arrangement.

Multi-cylinder internal combustion engine 10 includes a cylinder head 14 mounted on a cylinder block (not shown) so as to close off the cylinder C1–C6 which are formed in the cylinder block in a conventional manner. Intake port injection system 12 includes an intake manifold 16 preferably integrally formed in cylinder head 14. Intake port injection system 12 further includes a pair of intake ports including a first intake port 18 and a second intake port 20, associated with, and opening into, respective cylinders C1–C6. Each pair of intake ports 18, 20 are connected to intake manifold 16 by a plurality of intake inlets 22 for delivering air from manifold 16 to the intake ports for delivery into the respective cylinders. Importantly, first and second intake ports 18 and 20 associated with each cylinder and the plurality of intake inlets 22 are positioned to form a siamese or shared port arrangement wherein intake ports from adjacent cylinders share a common intake inlet connecting the ports to intake manifold 16. Specifically, in the six-cylinder engine of the present embodiment, the plurality of intake inlets 22 includes five common intake inlets 24 each connected to one intake port from one cylinder and one intake port associated with an adjacent cylinder as shown in FIG. 1. The plurality of intake inlets 22 also includes a first single intake inlet 26 associated with cylinder C1 and a second single intake inlet 28 associated with cylinder C6. Single intake inlets 26 and 28 are dedicated to a single cylinder and, therefore, do not deliver air to any other cylinder. In the present embodiment, cylinder C1–C6 are positioned in-line to form a bank of cylinders wherein cylinder C1 and cylinder C6 are positioned as end cylinders and single intake inlets 26 and 28 are positioned at respective ends of the bank of cylinders.

Intake port injection system 12 also includes a plurality of injectors I1, I2, I3, I4, I5, I6 and I7 for delivering fuel to cylinders C1–C6. As shown in FIGS. 1 and 2, each of the injectors I1–I7 are mounted on cylinder head 14 and project into intake manifold 16. Each injector is positioned so that the fuel spray from the injector nozzle is directed toward a respective one of the plurality of intake inlets 22. The nozzle tip of each injector is preferably positioned close enough to the respective intake inlet 22 so as to ensure the fuel spray is carried into the respective inlet and downstream through the open intake port into the cylinder by the intake air flow. As shown in FIG. 1, each of the injectors I2–I6 are positioned to inject fuel into a respective one of the common intake inlets 24. Injectors I1 and I7 are, on the other hand, positioned to inject fuel into a respective one of the single intake inlets 26, 28. It should be noted also that the injectors can be used to inject liquid or gaseous fuels as desired.

Figure 3:
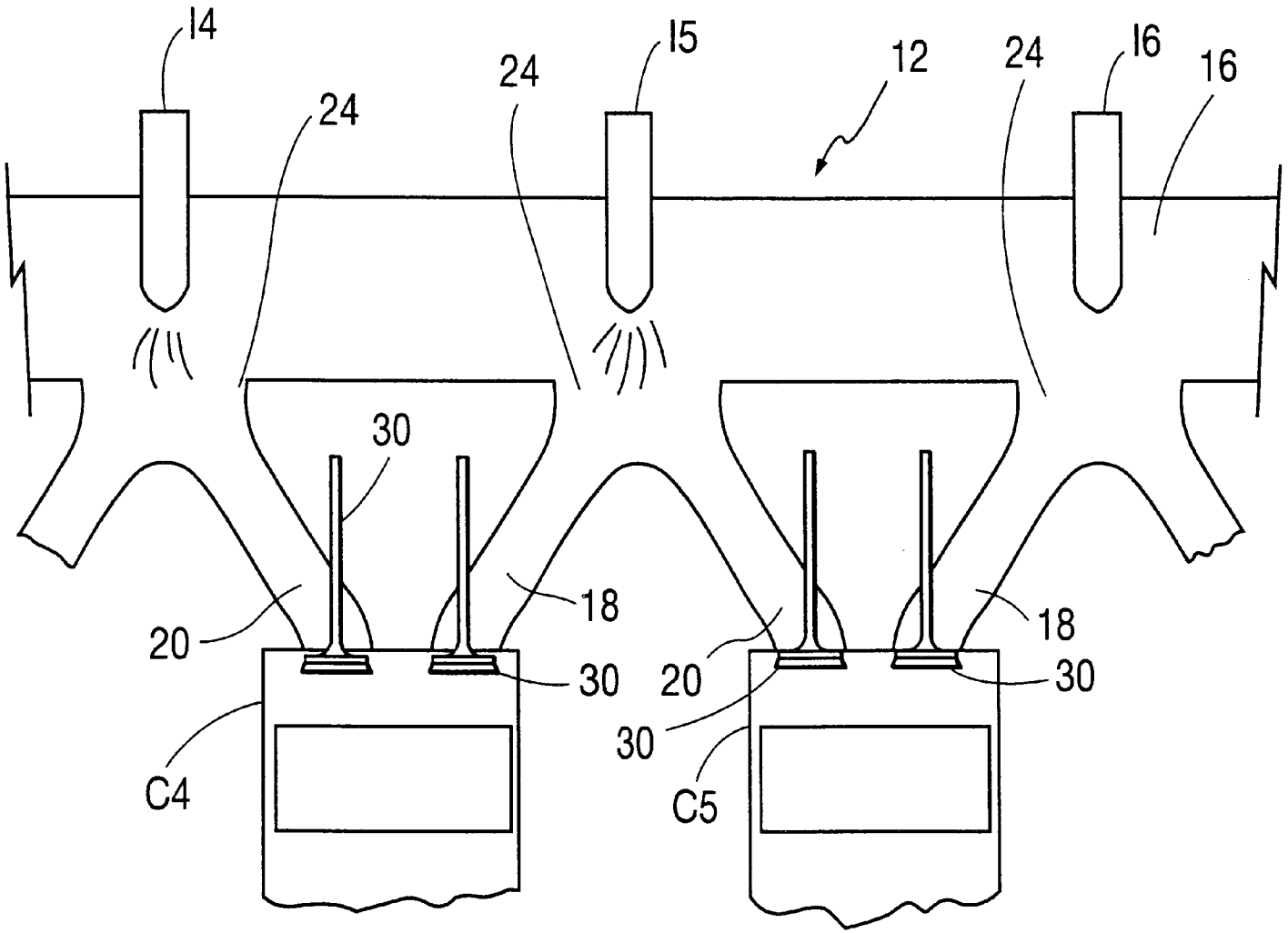
FIG. 3 is a side schematic view of a portion of the intake port injection system of FIGS. 1 and 2.

Referring to FIG. 3, intake port injection system 12 also includes an intake valve 30 associated with each intake port for opening and closing the intake port during engine operation to define an intake event for a cylinder. For example, as shown in FIG. 3, intake valves 30 associated with cylinder C4 opens and closes to define an intake event during which fuel is injected into cylinder C4. Importantly, and in accordance with the present invention, in the example shown in FIG. 3, both fuel injectors I4 and I5 will operate during the intake event to inject a respective quantity of fuel into the respective common intake inlet 24. That is, injector I4 will inject fuel into the common intake inlet 24 associated with cylinders C3 and C4. Likewise, injector I5 will inject fuel into common intake inlet 24 associated with cylinders C4 and C5. However, since only intake valves 30 associated with cylinder C4 are open while the intake valves associated with cylinders C3 and C5 are closed, the intake air stream flowing from intake air manifold 16 into the intake ports 18, 20 associated with cylinder C4, will direct the respective fuel spray quantities into intake ports 18 and 20 and into cylinder C4 as opposed to flowing into the ports associated with cylinder C3 and C5. In a similar manner, at another time during engine operation, intake valves 30 associated with intake ports 18 and 20 will be closed while the intake event for cylinder C5 is occurring by the opening of its associated intake valves. During the intake event for cylinder C5, fuel injector I5 will again inject fuel into its respective common intake inlet while injector I6 also injects fuel into its respective common intake inlet. However, the intake valve 30 associated with intake port 18 of cylinder C4 and the intake valve associated with cylinder C6, will both be in the closed position. As a result, the fuel injected into the respective common intake inlets 24 by injectors I5 and I6, will flow into the intake ports associated with cylinder C5 and will not be directed into the ports associated with cylinders C4 and C6. Likewise, during the intake event for cylinder C1, injectors I1 and I2 will simultaneously deliver fuel to single intake inlet 26 and the common intake inlet 24 associated with injector I2, respectively, as shown in FIG. 1. A similar event occurs with respect to cylinder C6 so that injector I7 injects fuel into single intake inlet 28 simultaneously with injector I6 so that a full supply of fuel is delivered to cylinder C6 during the intake event.

Figure 4:
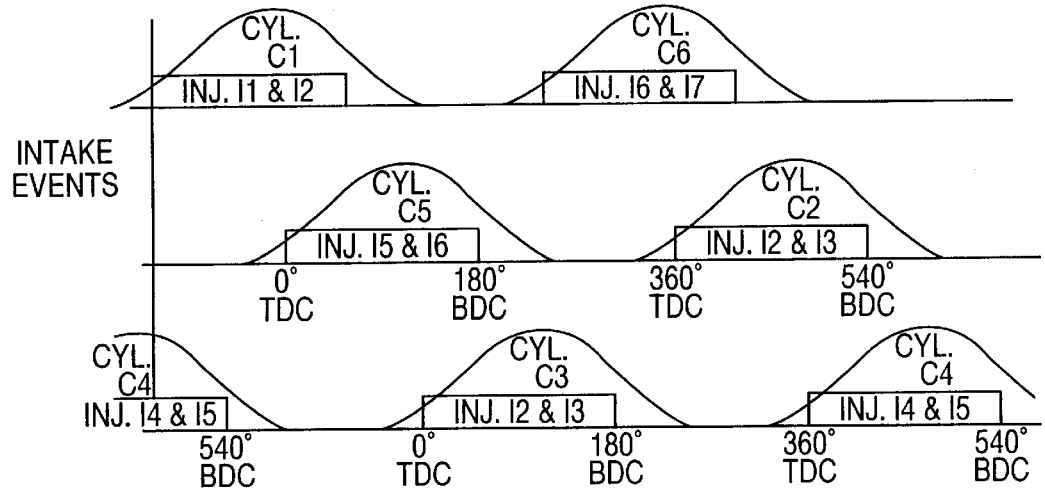
FIGS. 4 and 5 are charts showing the correlation of the intake events and the injection events, and the relative timing of the injection events, respectively.
Figure 5:
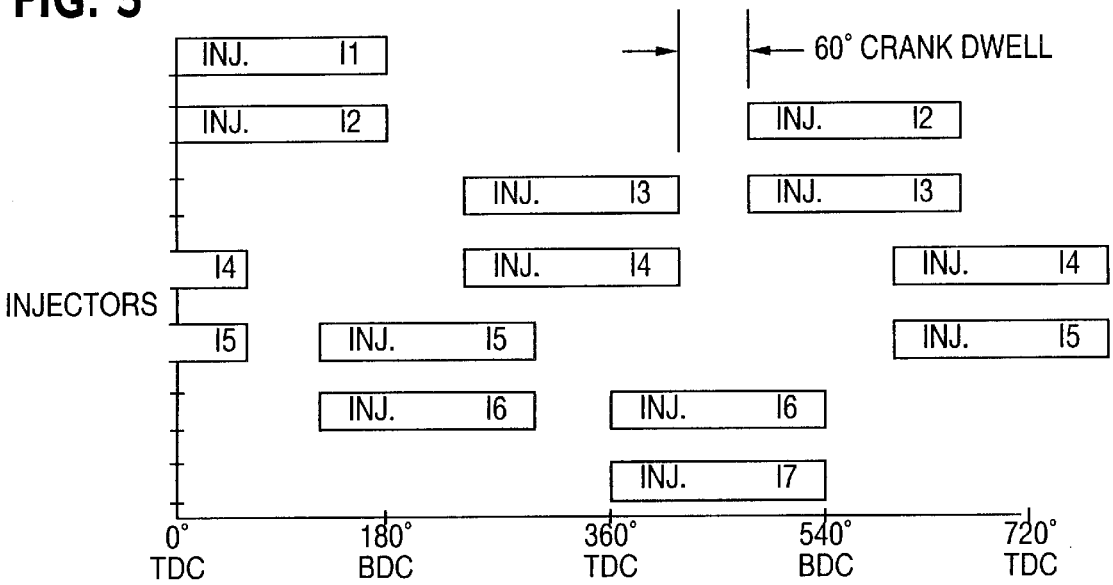

Referring now to FIGS. 4 and 5, the timing of the opening and closing of intake valves 30, i.e. intake events, and the injection events of injectors I1–I7, are shown relative to one another for each of the cylinder C1–C6. As shown in FIG. 4, a given pair of injectors operating during a given intake event inject fuel only after the pair of intake valves associated with a respective cylinder have started to move toward the open position. In this manner, fuel is injected only while an intake air flow stream is flowing into the cylinder so as to ensure the air flow directs all the injected fuel into the intake port associated with the open intake valve. Clearly, the order of the intake events associated with cylinders C1–C6 are such that the intake events of two cylinders served by a common injector do not occur during the same time period. In this manner, discreet controllable intake and injection events are created for predictable and reliable fuel injection into the appropriate cylinders. It is noted that with maximum injection duration and injection valve events, a 60° crank dwell between the injection pulses of injectors I2–I6 is easily provided to ensure reliability.

Although in the preferred embodiment, the present intake port injection system 12 is shown in conjunction with a six-cylinder internal combustion engine 10, as stated hereinabove, intake port injection system 12 may be incorporated into any multi-cylinder internal combustion engine having a total number of cylinders equal to N. Based on the present invention, the total number of intake inlets 22 associated with any multi-cylinder engine designed in accordance with the present invention would equal N+1. Also, regardless of the number of cylinders, the total number of injectors, for a multi-cylinder engine having a total number of cylinders equal to N, will be equal to N+1. The total number of common intake inlets, on the other hand, will always equal N−1.

The present invention results in several important advantages and distinctions over existing intake port injection systems. First, by combining a siamese or shared port arrangement with the single injector, port injection system of the present invention, the present intake port injection system 12 results in a minimum number of injectors for a multi-cylinder engine, i.e. a six-cylinder engine. Second, since two injectors are used to supply fuel to a single cylinder during each injection event, each injector need only be capable of supplying half the full fuel injection capacity for the injection event. As a result, the injectors are much smaller in size than a conventional single injector supplying the total fuel quantity to a given cylinder. In the present invention, each of the injectors will typically supply half the total fuel quantity delivered to a cylinder during an intake event. Consequently, the injectors can be more easily packaged into the engine overhead of existing and new engine designs. Also, ultimately, the use of a minimum number of smaller sized injectors reduces the overall cost of the engine. Also, the smaller capacity injectors tend to be more readily available as "off-the-shelf" injectors.

INDUSTRIAL APPLICABILITY

The intake port injection system of the present invention may be used in any multi-cylinder engine using dual intake valves per cylinder. Moreover, an internal combustion engine incorporating the intake port injection system of the present invention may be used in any vehicle or industrial equipment application.

We claim:

1. A multi-cylinder internal combustion engine, comprising:

a plurality of cylinders for receiving intake air and fuel, the total number of said plurality of cylinders equaling N number of cylinders, said total number of cylinders N including at least four cylinders;

a respective pair of intake ports associated with each of said plurality of cylinders for directing intake air into the respective cylinder;

an intake manifold;

a plurality of intake inlets for delivering intake air from said intake manifold to said intake ports, said plurality of intake inlets including one or more common intake inlets equal in number to N−1 and a plurality of single intake inlets, each of said one or more common intake inlets connected to both a first intake port associated with one of said plurality of cylinders and a second intake port associated a different one of said plurality of cylinders; and a plurality of injectors for injecting fuel into said plurality of intake inlets, the total number of said plurality of injectors equaling N+1, each of said plurality of intake inlets receiving fuel from only one of said plurality of injectors.

2. The engine of claim 1, wherein the total number of said plurality of intake inlets equals N+1.

3. The engine of claim 1, wherein two of said plurality of injectors operate simultaneously to deliver fuel through respective intake inlets for delivery to one of said pair of intake ports of one cylinder.

4. The engine of claim 1, wherein said plurality of injectors are mounted in said intake manifold.

5. The engine of claim 4, further including a cylinder head, said intake manifold being formed integrally in said cylinder head.

6. The engine of claim 3, further including a pair of intake valves associated with said pair of intake ports, said two injectors operating during opening of said pair of intake valves.

7. The engine of claim 1, wherein the total number of cylinders N equals six.

8. The engine of claim 1, wherein said plurality of cylinders are positioned along a common longitudinal axis to form a bank of cylinders, including a first end cylinder positioned at a first end of said bank of cylinders and a second end cylinder positioned at a second opposite end of said bank of cylinders, the total number of said plurality of single intake inlets equaling two, said two single intake inlets including a first single intake inlet positioned at said first end and a second single intake inlet positioned at said second opposite end.

9. The engine of claim 8, wherein the total number of cylinders N equals six.

10. A multi-cylinder internal combustion engine, comprising:

a plurality of cylinders for receiving intake air and fuel, the total number of said plurality of cylinders equaling N number of cylinders, said total number of cylinders N including at least four cylinders;

a respective pair of intake ports associated with each of said plurality of cylinders for directing intake air into the respective cylinder;

a plurality of intake inlets for delivering intake air to said intake ports, said plurality of intake inlets including one or more common intake inlets and a two single intake inlets, each of said one or more common intake inlets connected to both a first intake port associated with one of said plurality of cylinders and a second intake port associated a different one of said plurality of cylinders, each of said two single intake inlets connected to only one of said plurality of cylinders, wherein the total number of said plurality of intake inlets equals N+1 and the total number of said one or more common intake inlets equals N−1; and a plurality of injectors for injecting fuel into said plurality of intake inlets, each of said plurality of injectors being associated with a different one of said plurality of intake inlets, wherein each of said plurality of injectors operate simultaneously with another one of said plurality of injectors to deliver fuel through respective intake inlets for delivery to one of said pair of intake ports.

11. The engine of claim 10, wherein the total number of said plurality of injectors equals N+1.

12. The engine of claim 10, further including a cylinder head and an intake manifold formed integrally in said cylinder head.

13. The engine of claim 12, wherein said plurality of injectors are mounted in said intake manifold.

14. The engine of claim 3, further including a pair of intake valves associated with said pair of intake ports, each of said plurality of injectors operating during opening of said pair of intake valves.

15. The engine of claim 10, wherein the total number of cylinders N equals six.

16. The engine of claim 10, wherein said plurality of cylinders are positioned along a common longitudinal axis to form a bank of cylinders including a first end cylinder positioned at a first end of said bank of cylinders and a second end cylinder positioned at a second opposite end of said bank of cylinders, said two single intake inlets including a first single intake inlet positioned at said first end and a second single intake inlet positioned at said second opposite end.

17. The engine of claim 16, wherein the total number of cylinders N equals six.

* * * * *